US006062963A

United States Patent [19]

Lin et al.

[11] Patent Number: 6,062,963

[45] Date of Patent: May 16, 2000

[54] RETAINER RING DESIGN FOR POLISHING HEAD OF CHEMICAL-MECHANICAL POLISHING MACHINE

[75] Inventors: Juen-Kuen Lin, Kaohsiung; Chien-Hsin Lai, Kaohsiung Hsien; Peng-Yih Peng, Hsinchu Hsien; Hao-Kuang Chiu, Hsinchu; Kun-Lin Wu, Tai Chung, all of Taiwan

[73] Assignee: United Microelectronics Corp., Hsin-Chu, Taiwan

[21] Appl. No.: 09/059,750

[22] Filed: Apr. 14, 1998

[30] Foreign Application Priority Data

Dec. 1, 1997 [TW] Taiwan ..... 86118024

[51] Int. Cl.[7] ..... B24B 5/00; B24B 47/02

[52] U.S. Cl. ..... 451/398; 451/41; 451/397; 451/288; 451/286

[58] Field of Search ..... 451/41, 60, 36, 451/285, 287, 288, 289, 397, 398, 286, 402, 446, 388, 387, 283

[56] References Cited

U.S. PATENT DOCUMENTS

| | | | |
|---|---|---|---|
| 3,375,614 | 4/1968 | Boettcher et al. | 51/129 |
| 4,739,589 | 4/1988 | Brehm et al. | 51/281 R |
| 5,032,203 | 7/1991 | Doy et al. | 156/345 |
| 5,232,875 | 8/1993 | Tuttle et al. | 437/225 |
| 5,597,346 | 1/1997 | Hempel, Jr. | 451/36 |
| 5,695,392 | 12/1997 | Kim | 451/41 |
| 5,725,420 | 3/1998 | Torii | 451/285 |

*Primary Examiner*—David A. Scherbel
*Assistant Examiner*—Derris H. Banks
*Attorney, Agent, or Firm*—Christie, Parker & Hale, LLP

[57] ABSTRACT

A chemical-mechanical polishing machine having an improved wafer retainer ring design for the polishing head, comprising a polishing table, a polishing pad, a polishing head and a wafer retainer ring, wherein the polishing pad is above the polishing table, the polishing head is above the polishing pad, and the wafer retainer ring is mounted onto the polishing head. Improvement of the retainer ring design includes the formation of a plurality of guiding holes around the periphery of the retainer ring such that the guiding hole axis follows the centrifugal line produced by a rotating polishing head. Furthermore, the guiding hole has a gradual diffusing structure from the outer inlet to the inner outlet.

10 Claims, 6 Drawing Sheets

RETAINER RING DESIGN FOR POLISHING HEAD OF CHEMICAL-MECHANICAL POLISHING MACHINE

CROSS-REFERENCE TO RELATED APPLICATION

This application claims the priority benefit of Taiwan application serial no.86118024, filed Dec. 1, 1997, the full disclosure of which is incorporated herein by reference.

BACKGROUND OF THE INVENTION

1. Field of Invention

The present invention relates to the polishing head of a chemical-mechanical polishing (CMP) machine. More particularly, the present invention relates to an improved retainer ring design for the polishing head.

2. Description of Related Art

Chemical-mechanical polishing is a global planarization technique providing planar surfaces for very large scale integration (VLSI) or even ultra-large scale integration (ULSI) circuits. As shown in FIGS. 1A and 1B, a conventional chemical-mechanical polishing machine has a polishing table 10 and a polishing pad 12 above the polishing table. The chemical-mechanical polishing machine also has a polishing head. Inside a polishing head 14, a wafer 16 whose top surface is facing down is loaded between the polishing head 14 and the polishing pad 12. Slurry 18 is carried to the polishing pad surface through a supply pipeline.

FIG. 1C is a detailed cross-sectional view of the polishing head 14. As shown in FIG. 1C, at the upper end of the polishing head 14 there is an air chamber 20 for exerting pressure on a wafer loader 22 below. At the periphery below the wafer loader 22, there is a wafer retainer ring 24 for retaining a wafer 16 within. In addition, a buried pad (not shown in the Figure) is usually installed between the wafer loader 22 and the wafer 16.

FIGS. 2A and 2B show the respective top view and a bottom view of a conventional wafer retainer ring 24. As shown in FIGS. 2A and 2B, the retainer ring 24 is a smooth circular structure having an outer diameter of about 25.4 cm and inner diameter of about 22.86 cm. Due to a lack of conduit structures in the retainer ring 14 for allowing the slurry to enter the polishing head, slurry is difficult to get to the central portion during polishing operation. Furthermore, the cycling of slurry is spasmodic, and hence resulting in an unevenly polished wafer surface. In other words, polishing defects such as non-uniformity, big wafer edge exclusion, slow polish-removal rate, ineffective use of slurry, and a reduced lifetime for polishing pad and buried pad will arise.

In light of the foregoing, there is a need to provide an improved wafer retainer ring design for the polishing head.

SUMMARY OF THE INVENTION

Accordingly, the present invention is directed to improve the wafer retainer ring design such that an increased quantity of smoothly flowing slurry can enter the polishing head during a chemical-mechanical polishing operation. Consequently, the polished wafer has a better surface uniformity, smaller wafer edge exclusion, increased polishing rate and a longer useful life for the polishing pad and the buried pad.

To achieve these and other advantages and in accordance with the purpose of the invention, as embodied and broadly described herein, the invention provides a polishing head retainer ring for a chemical-mechanical polishing machine. The retainer ring comprises a polishing table, a polishing pad, a polishing head and a wafer retainer ring, wherein the polishing pad is above the polishing table, the polishing head is above the polishing pad and the wafer retainer ring is mounted onto the polishing head. The improved retainer ring design includes a plurality of guiding holes whose axis are in line with the centrifugal lines radiating from the center of the wafer retainer ring.

According to one preferred embodiment of this invention, the polishing head includes an air chamber, a wafer loader, and a buried pad, and the guiding holes on the retainer ring is designed to space equidistantly around the retainer ring. Moreover, each guiding hole has a diffusion angle defined to diffuse from the outer periphery of the retainer ring towards the inner periphery. The best diffusion angle is found to be between 0° to 10°. Angle for the opening of each guiding hole is found using a calculation involving the velocity vector generated by a rotating polishing head.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings, FIG. 1A (Prior Art) is a top view showing the overall structural layout of a conventional chemical-mechanical polishing machine.

DESCRIPTION OF THE PREFERRED EMBODIMENTS

Figure 1A:
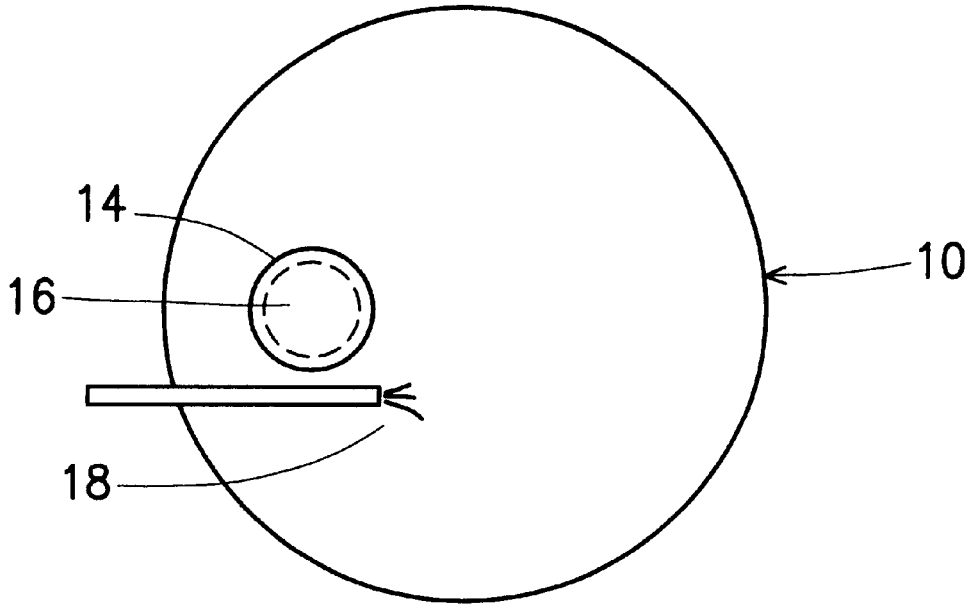
FIG. 1A (PRIOR ART)
FIG. 1B (Prior Art) is a cross-sectional view showing the overall structural layout of a conventional chemical-mechanical polishing machine.
FIG. 1C (Prior Art) is a magnified and detailed view of the polishing head portion in FIGS. 1A and 1B.
Figure 1B:
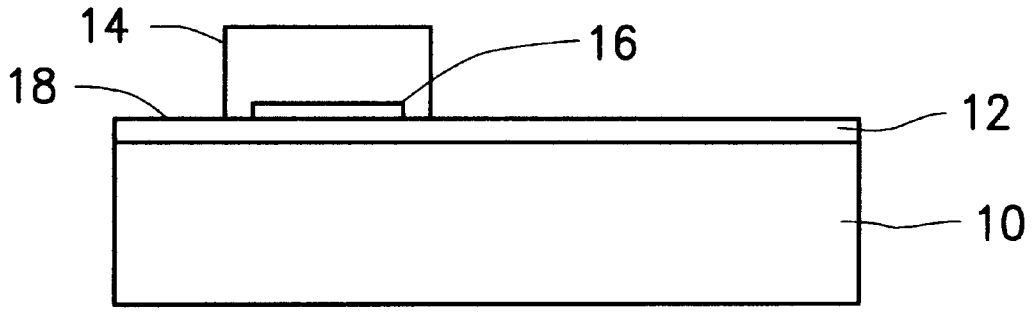
FIG. 1B (PRIOR ART)
Figure 1C:
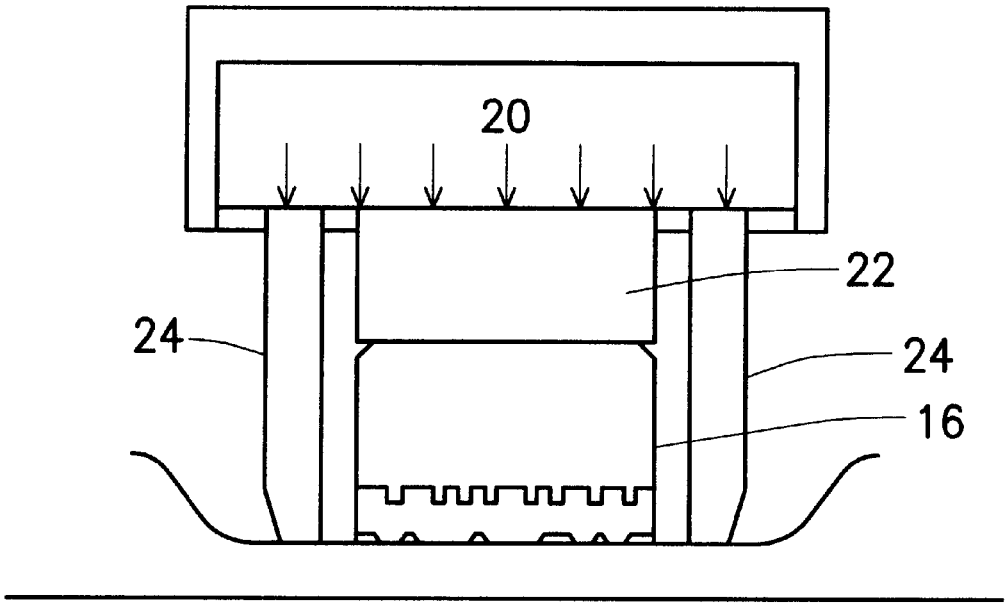
FIG. 1C (PRIOR ART)
Figure 2A:
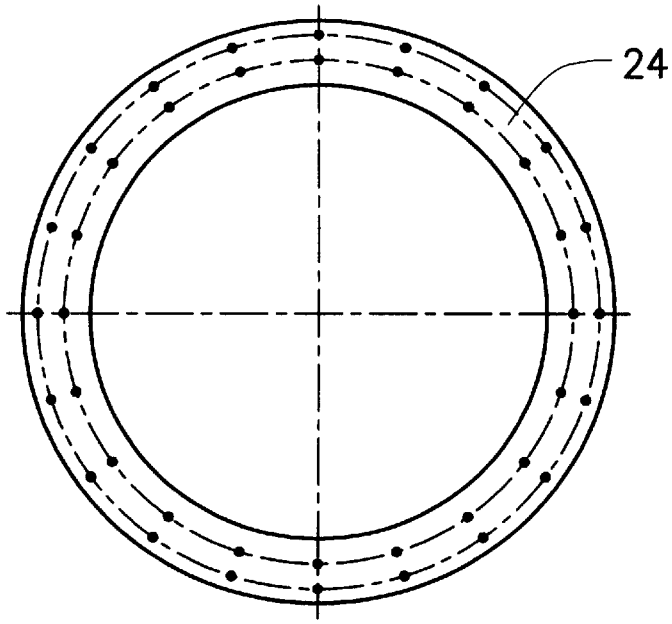
FIG. 2A (PRIOR ART)
FIGS. 2A and 2B (Prior Art) show the respective top view and a bottom view of a conventional wafer retainer ring.
Figure 2B:
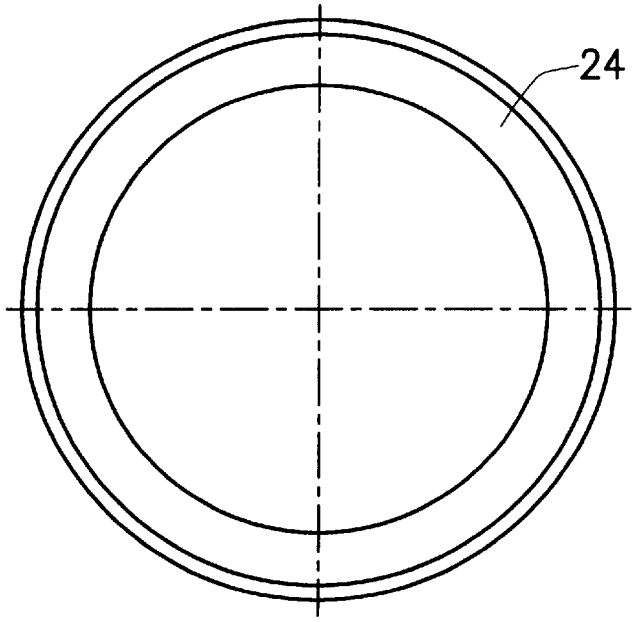
FIG. 2B (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

Figure 3A:
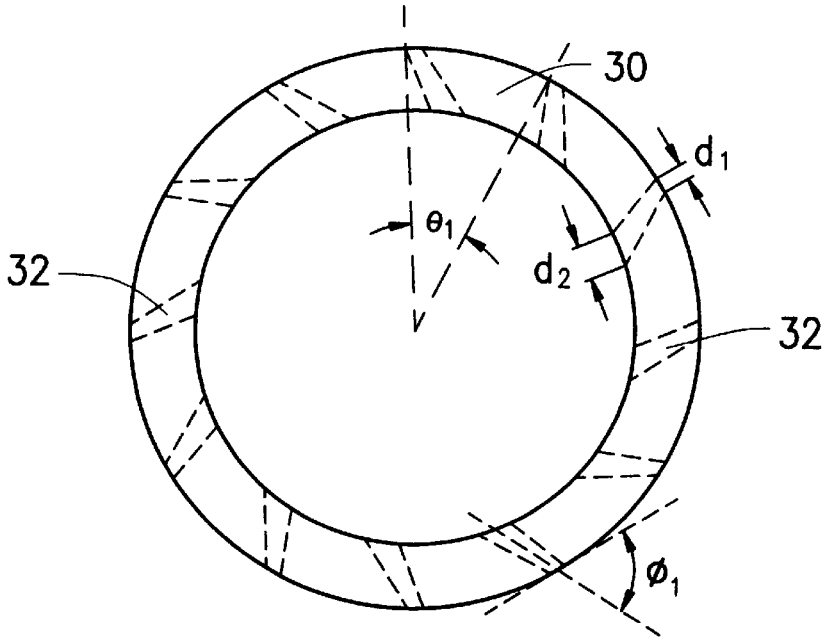
FIG. 3A is a top view showing the polishing head retainer ring of a chemical-mechanical polishing machine designed according to one preferred embodiment of this invention.
Figure 3B:
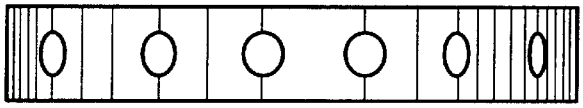
FIG. 3B is a side view showing the polishing head retainer ring of a chemical-mechanical polishing machine designed according to one preferred embodiment of this invention.
Figure 3C:
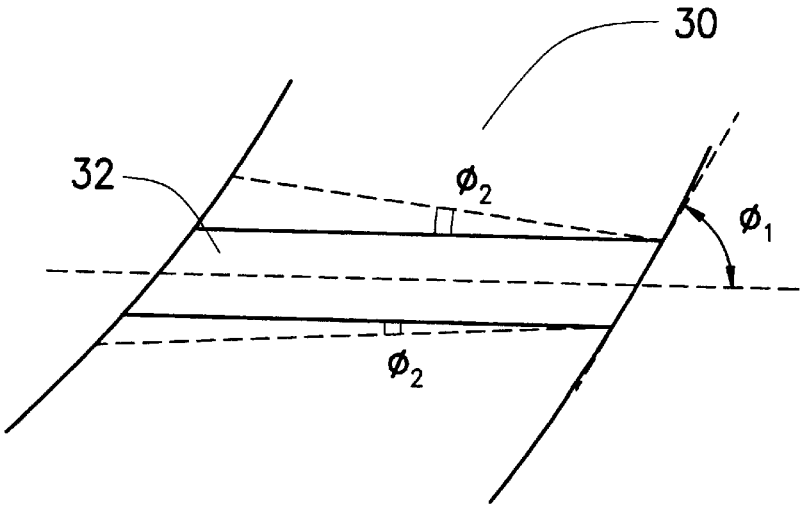
FIG. 3C is a magnified portion of the top view as shown in FIG. 3A.

FIGS. 3A through 3C show respectively the top and side views of a polishing head retainer ring of a chemical-mechanical polishing machine according to one preferred embodiment of this invention. The outer diameter of the retainer ring 30 is about 25.40 cm while the inner diameter is about 22.86 cm. To enable the slurry to cycle smoothly and in a greater quantity into the polishing head so that a uniform polished surface is obtained, a number of guiding holes 32 are formed around the retainer ring in line with the centrifugal direction of the rotating polishing head. For example, twelve equidistantly separated guiding holes each having a gradually diffusing profile in the form of a narrower outer inlet to a wider inner outlet is formed. The guiding hole 32 has an opening angle whose angle of attack $\phi_1$ is calculated according to the velocity vector of a rotating polishing head. In addition, the diffusion angle $\phi_2$ of the guiding holes 32 is calculated based on the width of the retainer ring 30 (for example, 25.40 cm−22.86 cm=2.54 cm).

Figure 4A:
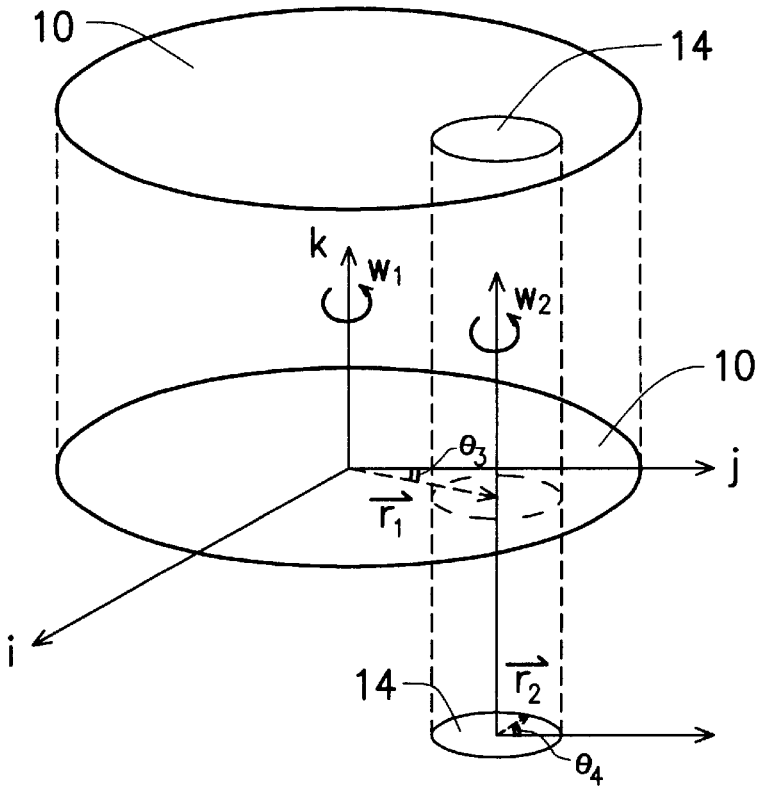
FIGS. 4A through 4D show theoretical basis for the design of retainer ring according to one preferred embodiment of this invention.

FIGS. 4A through 4D show theoretical basis for the design of retainer ring according to one preferred embodiment of this invention. First, calculation for the velocity vector $\vec{V}_h$ generated by the polishing head as it rotates is shown in FIG. 4A. In the Figure, the polishing table 10 is rotating at an angular speed of $\vec{\omega}_1$, where $\vec{r}_1$ is a positional vector leading from the center of the polishing table 10 to the center of the polishing head 14, $\theta_3$ is an angle formed by the line from the center of the polishing table 10 to the center of the polishing head 14 with respect to the coordinate axis j, $\vec{\omega}_2$ is the angular speed of the polishing head 14, $\vec{r}_2$ is a radius vector from the center of the polishing head 14, $\theta_4$ is angle formed by the vector $\vec{r}_2$ and the coordinate axis j. The velocity vector $\vec{V}_h$ is given by the following formula:

$$\vec{V}_h = \vec{\omega}_1(\vec{r}_1 + \vec{r}_2) + \vec{\omega}_2\vec{r}_2 = (r_1\omega_1\cos\theta_1 + r_2\omega_1\cos\theta_2 + r_2\omega_2\cos\theta_2)i - (r_1\omega_1\sin\theta_1 + r_2\omega_1\sin\theta_2 + r_2\omega_2\sin\theta_2)j = Ai + Bj$$

Figure 4B:
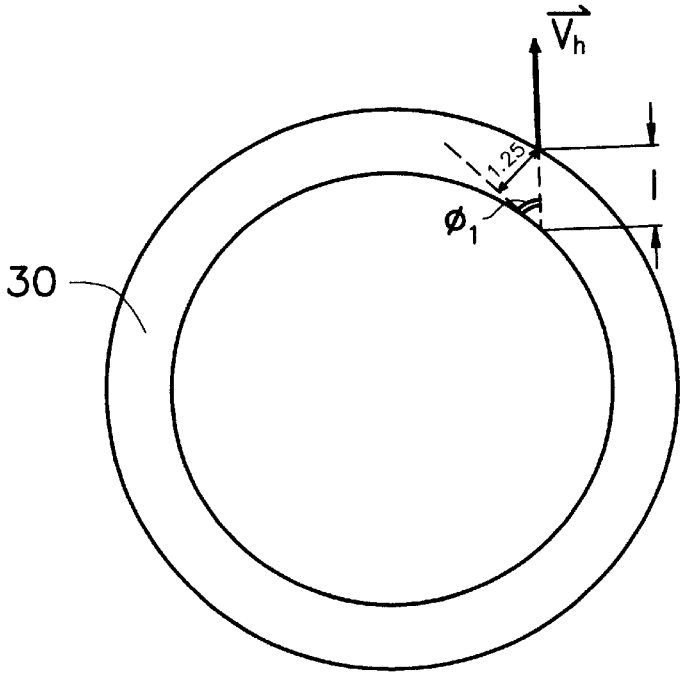

FIG. 4B is a magnified view of the retainer ring 30 of the polishing head 14. According to the calculated velocity vector $\vec{V}_h$ generated by the rotating polishing head, the cutting angle $\phi_1$ with respect to the tangent of the retainer ring 30 is given to be:

$$\tan\varphi_1 = \frac{A}{B}$$

$$\Rightarrow \varphi_1 = \tan^{-1}\frac{A}{B}$$

$$\Rightarrow \sin\varphi_1 = \frac{1.25}{l}$$

$$\Rightarrow l = \frac{1.25}{\sin\varphi_1}$$

Hence, from the above calculation, the guiding hole opening angle $\phi_1$ with respect to the tangent of the retainer ring 30 can be calculated.

Figure 4C:
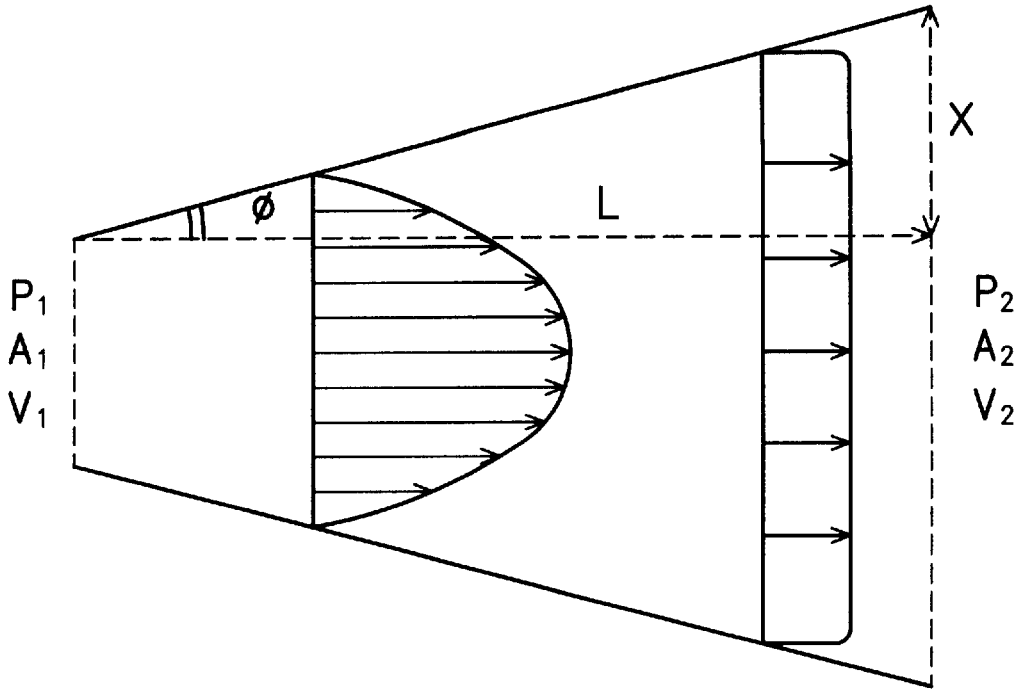

In this invention, the guiding hole is designed such that the diameter of the hole gradually increases from outer perimeter to the inner perimeter of the retainer ring 30. The reason is that with this design, the positive pressure gradient can be lowered and flow separation can be minimized. This will result in an increase in volumetric flow. As shown in FIG. 4C, $P_1$, $A_1$ and $V_1$ represent the pressure, cross-sectional area and the velocity of flow at the inlet respectively, while $P_2$, $A_2$ and $V_2$ represent the pressure, cross-sectional area and the velocity flow at the outlet respectively; $\phi_2$ is the diffusion angle; L is the length of forward distance; and x is the diffusion distance. If pipeline and gravity friction are negligible, the liquid is incompressible, and furthermore, ignoring vortex at the inlet, resistance at the outlet, and external vibrations, the Bernoulli equation below is applicable:

$$P + \frac{1}{2}\rho V^2 = P_0 = const \tag{1}$$

wherein P, V and ρ represent pressure, velocity and density respectively, and $P_o$ represents the stagnation pressure. The coefficient of depressurization $C_p$ is defined as the ratio of the difference between outlet to inlet pressure versus the difference between the stagnation pressure to the inlet pressure. In other words, substituting in equation (1), the following equation is obtained, $$C_p = \frac{P_2 - P_1}{P_0 - P_1} = 1 - \frac{P_0 - P_2}{P_0 - P_1} = 1 - \left(\frac{V_2}{V_1}\right)^2 \tag{2}$$

and together with the continuity equation, $$Q = A_1V_1 = A_2V_2 \tag{3}$$

the following equation is finally obtained, $$C_p = 1 - \left(\frac{A_1}{A_2}\right)^2$$

Figure 4D:
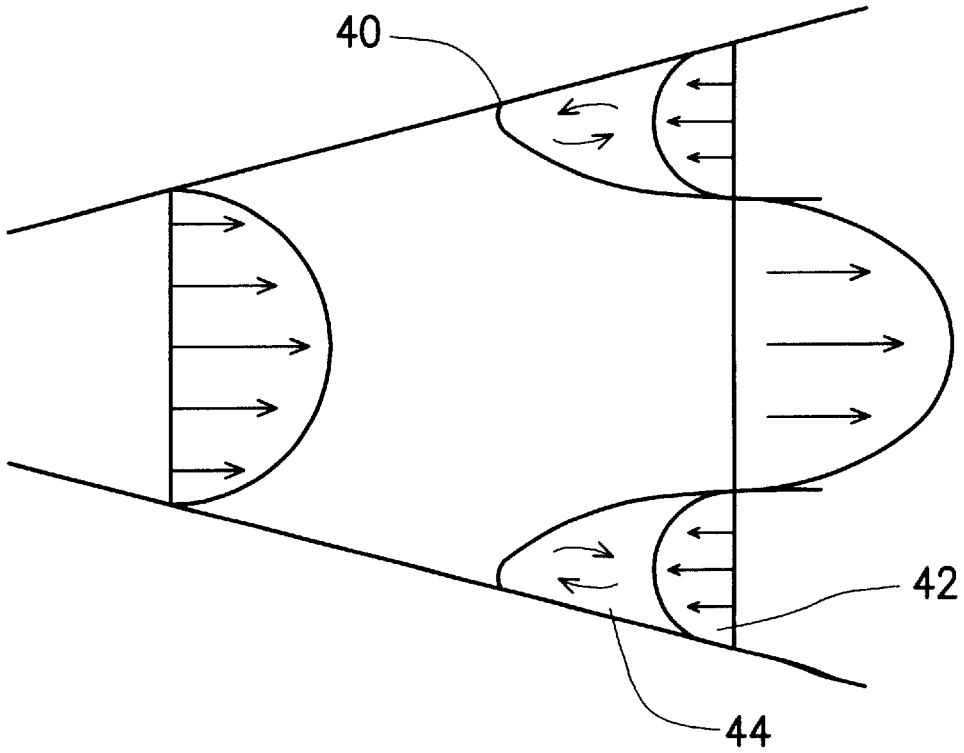

From the above equation, higher the value of $C_p$, the higher will be the ratio $$\frac{A_2}{A_1},$$

which represents a better diffusing effect. However, when the ratio $$\frac{A_2}{A_1}$$

is getting bigger, the diffusion angle $\phi_2$ has to be bigger too. When $\phi_2$ is bigger than 10° as shown in FIG. 4D, separation 40 or speed stalling 42 may occur. In more serious situations, inverse flow 44 will occur leading to a reduction in the across area, which is undesirable.

As a summary for the above discussion, parameters determining the design of the guiding holes include:

$$\tan\varphi_2 = \frac{x}{L}, \tag{1}$$

$$\varphi_2 < 10°, \text{ and} \tag{2}$$

$$\frac{A_2}{A_1}. \tag{3}$$

According to this invention, when the outer diameter of the retainer ring 30 is about 25.40 cm and inner diameter is about 22.86 cm, the guiding hole preferably has an outer diameter $d_1$ of about 1 cm and an inner diameter $d_2$ of about 1.8 cm, the included angle $\theta_1$ between two guiding holes 32 is preferably about 30°, and the included angle $\phi_1$ between the hole center line and a retainer ring tangent is preferably about 30°.

Therefore, the present invention improves the wafer retainer ring design by the introduction of guiding holes such that an increased quantity of smoothly flowing slurry can enter the polishing head during a chemical-mechanical polishing operation. Consequently, the polished wafer has a better uniformity, smaller wafer edge exclusion, increased polishing rate and a longer life for the polishing pad and the buried pad.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chemical mechanical polishing machine having an improved water retainer ring design for a polishing head thereof, wherein the chemical mechanical polishing machine comprises:

a polishing table;

a polishing pad above the polishing table;

the polishing head above the polishing table; and a wafer retainer ring mounted on the polishing head, wherein the retainer ring has a plurality of periphery guiding holes whose profiles are gradually narrowing from an inner periphery toward an outer peripheral of the retainer ring.

2. The chemical-mechanical polishing machine of claim 1, wherein the polishing head of the chemical-mechanical polishing machine further comprises:

an air chamber on an upper part of the polishing head;

a wafer loader just below the air chamber for loading a wafer and transmitting a pressure exerted by the air chamber to the wafer; and a buried pad, installed between the wafer loader and the wafer.

3. The wafer retainer ring of claim 1, wherein the guiding holes is equidistantly spaced around the retainer ring.

4. The wafer retainer of claim 1, wherein each guiding hole has a diffusion angle such that the guiding holes have a direction of diffusion from outer periphery of the retainer ring towards inner periphery thereof.

5. The wafer retainer ring of claim 1, wherein the guiding holes has a gradually diffusing structure from outer inlet towards the inner outlet.

6. The wafer retainer of claim 1, wherein the guiding holes each has a diffusion angle within the range of 0° to 10°.

7. The wafer retainer of claim 1, wherein an angle formed between the axis of each guiding hole and a tangent to the retainer ring is calculated according to a velocity vector generated by rotating the polishing head.

8. A chemical mechanical polishing machine having a rotatable polishing head capable of rotating in a centrifugal direction and an improved wafer retainer ring mounted onto said polishing head, comprising:

a polishing table;

a polishing pad above the polishing table;

the polishing head above the polishing table; and a wafer retainer ring having a plurality guiding holes penetrating therethrough, said polishing head capable of rotating with a velocity while performing chemical mechanical polishing;

each of said guiding holes having an angle of attack calculated according to the velocity of the rotating polishing head;

a diffusion angle determined by the width of the retainer ring.

9. A wafer retainer ring adapted to be mounted on a rotatable polishing head of a chemical mechanical polishing machine for retaining a wafer to be polished, comprising:

an inner surface, at which the wafer is retained;

an outer perimeter;

a bottom surface; and said retainer ring having a plurality of guiding holes penetrating through the retainer ring from the inner surface to the outer surface;

each guiding having an angle of attack calculated according to the width of the retainer ring;

a diffusion angle determined by a velocity of rotation of the polishing head while performing a polishing process.

10. The retainer ring of claim 9, wherein the diffusion angle is in the range between 0° to 10°.

* * * * *